United States Patent [19]

Smith

[11] Patent Number: 4,727,402

[45] Date of Patent: Feb. 23, 1988

[54] AUTOMATIC COPIER SIGNATURE SET PRODUCTION

[75] Inventor: Richard E. Smith, Fairport, N.Y.

[73] Assignee: Xerox Corporation, Stamford, Conn.

[21] Appl. No.: 944,693

[22] Filed: Dec. 18, 1986

[51] Int. Cl.[4] ..... G03G 15/00

[52] U.S. Cl. ..... 355/14 SH; 355/3 SH; 355/24

[58] Field of Search ..... 355/14 SH, 3 SH, 24, 355/25, 26, 14 C, 14 CU, 14 R; 271/3, 185, 186, 4

[56] References Cited

U.S. PATENT DOCUMENTS

| | | | |
|---|---|---|---|
| H21 | 2/1986 | Schiek | 355/14 SH |
| 3,635,555 | 1/1972 | Kurahashi et al. | 355/8 |
| 3,987,722 | 10/1976 | Goodwin | 101/91 |
| 4,052,054 | 10/1979 | Cardwell et al. | 271/227 |
| 4,184,671 | 1/1980 | Sasamori | 271/18 |
| 4,190,354 | 2/1980 | Smith et al. | 355/24 |
| 4,315,687 | 2/1982 | Breuers et al. | 355/75 |
| 4,334,765 | 6/1982 | Clark | 355/14 SH |
| 4,469,319 | 9/1984 | Robb et al. | 271/3.1 |
| 4,592,651 | 6/1986 | Oikawa et al. | 355/72 |
| 4,595,187 | 6/1986 | Bober | 270/37 |
| 4,634,265 | 1/1987 | Tada | 355/24 X |
| 4,640,611 | 2/1987 | Ohdake et al. | 355/77 |
| 4,674,866 | 6/1987 | Tanaka | 355/24 X |

FOREIGN PATENT DOCUMENTS

| | | | |
|---|---|---|---|
| 54-164764 | 12/1979 | Japan . | |
| 56-88155A | 7/1982 | Japan | 35/83 |

OTHER PUBLICATIONS

1985 Printed Operator's Manual for the Xerox Corp. "1090" copier, pp. 25–27.

Xerox Disclosure Journal, vol. 9, #5, Sep./Oct. 1984, "Copy Rotator/Inverter", by R. E. Schaeffer at pp. 323–324.

"Separation and Sequencing to Achieve Reversion", Britt, et al, Xerox Disclosure Journal, Jan./Feb. 1985, vol. 10, No. 1, pp. 45–49.

*Primary Examiner*—A. C. Prescott

*Attorney, Agent, or Firm*—Paul F. Morgan

[57] ABSTRACT

Signature printing with an automatic duplexing copier by simultaneously presenting plural document sheets to the imaging station of the copier in a predetermined nonserial page order for producing a set of signature copy sheets suitable for subsequent center-folding into signature sets, by loading a normal serial set of document sheets into an automatic document reordering and presenting system (associated with the copier) which automatically reorders that set of document sheets into a predetermined nonserial reordered page order for signature pair page order "two-up" copying, and automatically presenting the pairs of automatically reordered document sheets to the imaging station of the copier to be copied in the reordered page order to provide collated page order signature sets automatically with the copier for on-line center-folding and finishing without requiring any manual reordering of either the document sheets or the signature copy sheets. The automatic reordering includes automatic 180° rotation of alternate pairs of simplex document sheets to provide proper orientation of the document pages for the automatic duplex copier. The document sheets are either automatically separated into two stacks for two document sheets to be presented simultaneously lengthwise (short-edge-first) in parallel to one side of the imaging station, or reordered into one stack for sideways (long-edge-first) presentation from an orthogonal direction.

34 Claims, 13 Drawing Figures

| | | | | | | | | | | | | | | | | | | | | | | | | |
|---|---|---|---|---|---|---|---|---|---|---|---|---|---|---|---|---|---|---|---|---|---|---|---|---|
| | | | | | | | | | | | | | | Total | Originals | 4 | 8 | 12 | 16 | 20 | 24 | | | |
| Document Postion on Platen | | | | | | | | | | | | | | | Start from | P | O | N | M | L | K | | | |
| Back > | | | | | | | | | | | | | | | | 4 | 6 | 8 | 10 | 12 | 14 | 16 | 18 | 20 | 22 | 24 |
| Front > | 31 | 29 | 27 | 25 | 23 | 21 | 19 | 17 | 15 | 13 | 11 | 9 | 7 | 5 | 3 | 1 | | | | | | | | | | |
| Start > | A | B | C | D | E | F | G | H | I | J | K | L | M | N | O | P | | | | | | | | | | |
| | First Pass (Sorter Off) | | | | | | | | | | | | | | | | | | | | | | | | | |
| | Second Pass Pass (Sorter On) | | | | | | | | | | | | | | | | | | | | | | | | | |
| Back > | 32 | 30 | 28 | 26 | 24 | 22 | 20 | 18 | 16 | 14 | 12 | 10 | 8 | 6 | 4 | 2 | | | | | | | | | | |
| Front > | | | | | | | | | | | | 3 | 5 | 7 | 9 | 11 | 13 | 15 | 17 | 19 | 21 | 23 | | |

PRIOR ART

*FIG. 7*

AUTOMATIC COPIER SIGNATURE SET PRODUCTION

AUTOMATIC COPIER SIGNATURE SET PRODUCTION

Cross-reference is made to commonly assigned U.S. application Ser. No. 897,570, filed Aug. 18, 1986 by Henry T. Bober and Michael S. Doery, entitled "Interactive System for Signature Production", and Ser. No. 912,014, filed Sept. 26, 1986 by Stephen R. Partilla & Ernest L. Dinatale, entitled "TWO UP AUTOMATIC DOCUMENT FEEDER FOR SIMPLEX TO DUPLEX COPYING", both of which are copending and incorporated by reference herein, the former particularly for the copier signature printing algorithms described therein, which are redisclosed herein.

This invention relates to copying apparatus and, more particularly, it relates to the automatic printing of signatures for the formation of booklets from individual ordered documents.

As is well known, a signature is a sheet containing plural (usually 4) printed pages (two on each side) with page arrangement such that when such sheets are center-folded and nested one inside of the other with other signature sheets in a set they become one collated pamphlet, booklet, or book; or a quire forming one section of a larger book. However, original documents presented to copiers are normally not in signature page arrangement or format. They are almost always in normal direct sequential serial page order, and with only one page or image on each sheet face. Given a series of original documents in such normal 1 to N serial page order, it is logical and desirable to make a booklet therefrom which maintains the identical page order. But if the booklet copies were formed from center-folded sheets of paper each carrying four copy images of the original documents made in their original page sequence, the booklets made up of these folded sheets would contain page images in an illogical order. Thus, it is known that a particular non-directly-sequential placement of images on each signature sheet is essential to providing a finished folded signature set or booklet with a direct sequential page order.

One of the most difficult challenges constraining greater use of on-line signature copy production and finishing in the copier art is this page reordering of the conventional input documents, whether single page (simplex) or dual opposing page (duplex) documents. Most prior art systems require manual page reordering and are relatively complex and not easily understood or used by the typical casual copier operator. It is desirable therefore to provide a new and improved automatic document sheet page reordering technique for input documents in the production of signatures to form booklets with a copier, especially to provide for proper "two-up" copying of two document pages simultaneously, as signature pairs input.

There is a further complexity and added difficulty with signature printing utilizing a conventional automatic duplexing copier. In conventional medium and high speed copiers, the copy sheets are moved through the copier, including through the duplex copy sheet inverting path, long-edge-first, i.e. in "landscape" format, rather than short-edge-first or "portrait" format as utilized in some lower speed copiers. Such a long-edge-first feeding paper path (and accompanying long-edge-first document feeder) has the significant advantage that the copy sheets are moving through the copier along their shortest dimension (their width) rather than their longest dimension (their length or height). Likewise, for the originals and their images. Thus a greater number of copy sheets and their corresponding images therefor may be processed through the copier in a given time.

However this normal, and desirable, operation of medium and high speed duplex copiers has a direct impact on the complexity of signature printing. In such copiers, signature printing is conventionally and desirably accomplished by placing two originals on the platen in "landscape" format one above the other, i.e., one extending lengthwise across the rear of the platen and the other extending lengthwise across the front of the platen (with the higher page numbers document being at the rear or back of the platen). This enables the most effective utilization of the platen dimensions for such copiers. Thus, for example, two conventional letter size ($8\frac{1}{2}'' \times 11''$) (21.6 cm.×28 cm.) documents may be placed in this manner on the 11.3" (28.7 cm.) wide×17" (43.2 cm.) front-to-rear dimensions of the platen of the "Xerox" "1090" copier described herein. With that orientation of the two standard document sheets on the platen, the two $8\frac{1}{2}''$ width document dimensions have a total, cumulative, dimension of 17 inches on the platen in said front-to-rear direction, and they both have the same, 11", extension in the other (width) dimension of the platen, therefore likewise fitting the platen in that dimension. Using the available automatic 64% optical reduction, both of these standard size documents can be copied onto a standard letter size copy sheet.

The problem this duplex copying presents for signature printing is that the document pair for one side of the signature sheet must be rotated 180° relative to the document pair for forming the opposite side of that signature sheet, for each signature sheet made in such an automatic duplexing copier. That is because this normal type of medium or high speed copier automatically turns the copy sheets over for their second side images but does not rotate them. Thus, if the document sheets were not alternately rotated for alternate sides of the signatures, the signature pages would be wrong side up (upside down) on one side of each signature sheet compared to the other.

Thus, as explained, for example, in the "1090" copier booklet-making instructions discussed herein, for making side "one" of each signature copy sheet the two documents must be placed on the platen with their tops facing the left side of the platen, and then for making side "two", the next signature pair of documents must be placed on the platen with the tops of those documents facing the right hand side of the platen. By doing so, the resulting signature sheets will have the proper orientation of page images, i.e. correctly reading from top to bottom on both sides of the signature sheets. As may be seen, this adds considerable complexity to manual or semiautomatic signature pair document handling. Not only must the copier operator place the correct, nonsequential, page numbered original pairs on the platen, they must be placed in the correct orientation on the platen, relative to the correct side of the platen. This requires orientation changes for each signature pair, i.e. one document pair must be oriented with the tops of the documents facing one side of the platen and the next document pair must be oriented on the platen with the tops of the documents facing the other side of the platen, etc.

With this complexity, it is hardly surprising that signature pair copying, even though it is a desirable function or feature, is not commonly practiced on duplex copiers except by very experienced operators, and is very error prone. With manual signature pair document handling, one slip in any of this complicated process of document page recording and rotation and variable orientation placement will result in whole sets of unusable copies which must be destroyed and recopied. Otherwise finished booklets would have pages out of order and/or upside down.

In contrast, the present system allows and encourages casual operator signature printing by eliminating all of the complexity and complications of page counting, page reordering, page rotation, page placements, page orientation, etc. of the original documents.

Of particular interest by way of art and background on signature copying of documents for pamphlet or booklet printing on a copier is U.S. Pat. No. 4,334,765 issued June 15, 1982 to G. A. Clark (IBM). (Note that the word "of" should be before "signatures" at Col. 1, line 61.) This patent demonstrates the difficulty and complexity of document signature pair sheet handling. Extensive manual document sheet reordering and copy handling is required. A recirculating document feeder is briefly generally suggested but not shown. Said U.S. Pat. No. 4,334,765 discloses the preparation of booklets by permitting somewhat simplified operator manipulations of a copier which forms adjacent images from sequential original sheets. An automatic document feeder presents successive original documents from an input stack to the reproduction position. The original documents are initially fed to the copier in a first sequence but are alternate page (not all) imaged. The originals are then restacked and are again presented to the reproduction position with previously unimaged originals forming images on different portions of the same copy sheets. A sorter is used to collate the copy sheets. Said U.S. Pat. No. 4,334,765 also states at the beginning of Col. 2 that: "In U.S. Pat. No. 4,188,881, filed July 28, 1977, originals are divided by the operator into two stacks which are used in rotation to prepare a master for double-size copy sheets."

Of particular interest in U.S. Pat. No. 4,592,651 issued June 3, 1986 to T. Oikawa, et al (Ricoh) which shows a copier with a duplex recirculating document handler and a center-folding book-binding device for the copies. Cols. 14–15 describe some signature copying formulas and Cols. 15–16 describe document copying sequences using immediate duplexing. However, this system does not allow "two-up" copying, which is more efficient, and it requires 4 copying passes for each copy sheet being signatured, and requires immediate duplex document inversion.

Also of interest in the art of signature printing is U.S. Pat. No. 3,987,722 issued Oct. 26, 1976 to E. L. Goodwin, especially FIGS. 8–10 and Cols. 3 and 12–15. However, this is not a copier, or a precollation copier. It discloses rearranging the masters for signature printing.

Said U.S. Pat. No. 4,334,765 patent at the beginning of Col. 2 refers to the "Xerox 7000 Signature Maker" "operator's instructions 61OP2625C". It is believed that this refers to a printed cardboard "slide rule" type device provided for several years by Xerox Corporation for assisting the operator in the difficult task of manually reordering the pages of the original document sheets into the reordered page sequences for a proper signature sequence of manual "two-up" document copying to provide signature copies, for a selected number of orginals set on this "slide rule" at a corresponding slide-out position. The "7000" copier also required manual document feeding and placement for "two-up" copying, and manual reloading of the first side copies for the second side copying to complete the signatures. Furthermore, the copier output required a sorter or collator for collation. (On the second pass the copies could be collated in the attached sorter of the "7000" copier.) Thus, it was known as described in the operator's instructions for the Xerox "7000" machine signature maker to manually use a calibrated table and to manually follow the step-by-step instructions for the placement of the correct page order of originals on a platen.

The making of signatures for booklet-making is also described in the 1985 printed operator's manual for the Xerox Corporation "1090" copier at pp. 25–27. A chart providing document page presentation orders is provided. Although this copier has a recirculating document feeder, it is not used for signature printing. Signature printing is done by manually reordering and presenting document sheets, as with the "7000" copier as previously described. The Xerox "1090" copier operator manual describes a step-by-step procedure to place documents on the platen with reference to a numbering table. As noted above, utilizing the large (greater than $11\times17$ inch) size copying capacity of the platen to copy two letter size ($8\frac{1}{2}\times11$ inch) documents simultaneously placed on the platen together with optical reduction can produce one side of a signature page copy of each document pair.

There is a known form of signature printing in which the "pages" of the "originals" are electronic master images, electronically arranged, rather than normal physical document sheets. The "Xerox" "9700" and "8700" electronic laser printers may be operated with automatic signature printing capabilities, referred to as "signature imposition" and specifically as the "Xerox integrated Compsoition System" or "XICX", in commercial use since at least March 1981, as understood. However, this system requires a computer and plural page electronic image storage. It runs software developed several years ago for electronic photocomposition typesetting. This can produce copy sheet output in signature sheets which are correctly "four-up", i.e. 4 pages on each sheet, two on each side, so that, for example, a set of signatures of 8 and one-half by 11 inch standard letter size sheets may be center-folded (once) into a 5 and one-half by 8 and one-half inch booklet. Collated sets of a publication can thus be made with the XICX system on the "9700" printer. This system cannot, of course, directly copy or rearrange conventional document sheets.

As to plural document feeding other than for signature printing, U.S. Pat. No. 4,315,687 issued Feb. 16, 1982 to Breuers et al (Oce-Nederland) and U.S. SIR No. H21 published Feb 4, 1986, disclose simultaneously copying plural small original sheets with a mask (form overlay) for providing additional information on the copy sheet. Likewise, a parallel document card stock feeder for a copier is shown in Japanese Application No. 54-164764 filed Dec. 20, 1979 by Ricoh Co., Ltd., laid open July 17, 1981 as Japanese Pat. Nos. 56-88064 and 56-88155(A).

The concept of manually positioning two regular size documents on the platen for copying simultaneously onto a single larger copy sheet (known as "two-up" copying) is disclosed, for example, as early as U.S. Pat. No. 3,402,628 to Redding. Note particularly the paragraph at the beginning of Col. 1. However, this is not for signature printing. Rather, it is for making plural copies from one copy sheet by subsequently slitting the copy sheet into separate copies. There are various other "two-up" document copying or printing systems in which the purpose and result is likewise to cut the copy sheet in half to make separate copy sheets of each document, not signatures. A further example in U.S. Pat. No. 4,198,881 issued Feb. 19, 1980 to E. C. Bruning (AM Internation, Inc.).

U.S. Pat. Nos. 3,288,459 issued Nov. 29, 1966 to A. M. Hitchcock et al; 3,326,548 issued June 20, 1987 to G. C. Wright; and 4,052,054 issued Oct. 4, 1977 to W. R. Cardwell et al (IBM), disclose an original document feeder for simultaneously feeding two original documents to be copied simultaneously. The former two illustrate and particularly describe in Col. 3, middle, through Col. 4, a document tray 2 with a reciprocating plate 54 adapted to hold two documents. It places the documents on a moving belt transport 3 for transporting the documents through a downstream scanning station 4. The ejection of the documents is subsequently by that transport belt into a tray 92. However, this is not for signature printing. The latter (Cardwell et al) discloses feeding two documents onto a platen to be copied simultaneously with a single document feeder. However, none of these systems teach automatic recirculating document feeders.

Also distinguishable from the present system are "split scan" systems wherein two document pages are presented to the platen at the same time, e.g. the facing pages of an open book. In a "split scan" mode one page is copied at a time. Note, for example, the 2-up special scanning and/or duplexing systems of Canon U.S. Pat. No. 4,098,551 issued July 4, 1978 to Komori et al; Canon U.K. Pat. No. 1,499,412 published Feb. 1, 1978; Ricoh U.S. Pat. Nos. 4,218,130 issued Aug. 19, 1980 to Satomi et al and Minolta 4,453,819 issued June 12, 1984 to Wada et al.

Since the exemplary embodiments shown and disclosed herein has an integral modular folder/fastener unit for making finished booklets from the collated signature sets output of the copier, further referenced in addition to U.S. Pat. Nos. 4,592,651, supra, is Xerox Corporation 4,595,187 issued June 17, 1986 to H. L. Buber (filed July 1985) which discloses an on-line saddle fastening accessory with a roof-shaped compiler and means for saddle-fastening each compiled booklet, for a collated output copier with a RDH. Other signature binders are well known int he printing arts, e.g. U.S. Pat. Nos. 3,554,531 issued Jan. 12, 1981 and 4,478,398 issued Oct. 23, 1984 to W. J. Stobb. U.S. Pat. No. 4,416,046 issued Nov. 22, 1983 to R. E. Stokes, discloses a stitcher and indicates in Col. 1, line 9 that it may be used for binding signatures.

A center folding system is also taught, for example, in U.S. Pat. No. 1,463,879 issued Aug. 7, 1923 to W. Downing. Likewise, in allowed and commonly assigned U.S. application Ser. No. 759,707, filed July 29, 1985 by H. Bober.

Of interest re sheet rotating mechanisms for rotating a sheet in its plane are the publications of the Xerox Disclosure Journal, Vol. 9, No. 5, Sept./Oct. 1984, pp. 323–324, entitled "Copy Rotator/Inverter" by R. E. Shaeffer and the IBM Technical Disclosure Bulletin Vol. 25, No. 12, May 1983, pp. 6656–9.

One form of automatic duplex copying of copy sheets with dual document images on one half of the copy sheet for center folding into books, including rotation of the copy sheets, is disclosed in Japanese application No. 59-99678 filed May 19, 1984.

The present system is particularly suitable for copiers with a sufficiently large platen area and copy sheet processing path size to accommodate two A4 size document sheets on the platen side-by-side and to allow them both to be copied onto a single large size copy sheet, such as A3 size. That is because a single A3 size copy sheet has the same area as two side-by-side A4 sheets, so that when the A3 sheets are center-folded they can be made into a booklet of 4 pages A4 size if it is signature printed. Also, A3 sheets can be fed short-edge-first through a copier processor designed for long-edge-first feeding of regular copy sheets. An ISO standard A3 sheet is approximately 29.7 cm. by 42 cm. or 11.69″×16.54″. An A4 sheet is approximately 21 cm. by 29.7 cm., or 8.27″×11.69″, which is close to the U.S. standard "letter size" (8.5″×11″ or 21.6×27.9 cm.). See, e.g., U.S. Pat. No. 4,298,277, for the Col. 14 table of standard sheet sizes.

Various copiers can provide large copy sheet copying. The Xerox "1055" copier and the Canon NP-8570 copier, for example, provide both copying and automatic on-line folding of 28 cm. by 43 cm. (11′ by 17″) copy sheets. [This size of sheets can be signature printed and center-folded into U.S. "letter" page size booklets.]

In the description herein the term "document" or "sheet" refers to a usually flimsy sheet of paper, plastic, or other such conventional individual image substrate, and not to microfilm or electronic images which are generally much easier to manipulate. It is important to distinguish electronic copying systems, such as the "9700" noted above, which read and store images of documents electronically and create copies by writing on a photoreceptor with a laser beam, or the like, since they do not have the problems dealt with here.

The "document" here is the sheet (original or previous copy) being copied in the copier onto the outputted "copy sheet", or "copy". Related plural sheets of documents or copies are referred to as a "set". A "simplex" document or copy sheet is one having an image and page on only one side or face of the sheet, whereas a "duplex" document or copy sheet has a "page", and normally an image, on both sides. The "page numbers" referred to herein are, of course, not necessarily actual numbers printed on the pages.

The present invention is particularly suitable for precollation copying, i.e. automatically plurally recirculated document set copying provided by a recirculating document handling system or "RDH", although is also compatible with nonprecollation or postcollation copying, such as semi-automatic document handling (SADH) as discussed above. Precollation, collation, recirculative, or RDH copying, as it is variably called, is a known desirable feature for a copier. It provides a number of important known advantages. In such precollation copying any desired number of collated copy sets or books may be made by making a corresponding number of recirculations of the set of documents in collated order past the copier imaging station and copying each document page (normally only once) each time it circulates over the imaging station. The copies therefrom may automatically exit the copier processor in proper order for stacking and offsetting as precollated sets, and thus do not require subsequent collation in a sorter or collator. On-line finishing (stapling, and/or gluing, or other binding and stacking) and/or removal of completed copy sets may thus be provided while further copy sets are being made in further circulations of the same document set.

In the known conventional (nonsignature printing) copy art, as in the normal operation of the Xerox Corporation "1090" copier, it is known to provide a recirculating document handler (RDH) to recirculate document sheets to and from a stack thereof on an automatic duplex copier (and to invert duplex documents) to provide collated duplex copy sheet sets. Automatic on-line finishing thereof as by compiling, stapling, stitching and/or gluing is provided. Some examples of U.S. RDH patents are U.S. Pat. Nos. 4,459,013 issued July 10, 1984 to T. J. Hamlin et al, 4,278,344 issued July 14, 1981 to R. B. Sahay, 4,579,444, 4,579,325 and 4,579,326. Some other examples of recirculating document handlers are disclosed in U.S. Pat. Nos. 4,076,408; 4,176,945; 4,330,197, 4,466,733 and 4,428,667. A preferred vacuum corrugating feeder air knife, and a tray, for an RDH are disclosed in U.S. Pat. Nos. 4,418,905 and 4,462,586. An integral semi-automatic and computer form feeder (SADH/CFF), which may be an integral part of an RDH, as noted in Col. 2, paragraph 2, therein, is disclosed in U.S. Pat. No. 4,462,527.

Of particular interest here is the large document RDH disclosed in U.S. Pat. No. 4,469,319 issued Sept. 4, 1984 to F. J. Robb, et al, and used on the Japanese version of the Xerox "1075" copier, capable of recirculating 257 mm. by 364 mm. (10.12×14.33 inch) documents.

However, a disadvantage of such precollation copying systems is that the documents must all be repeatedly separated and circulated sequentially for copying in a predetermined order a number of times equivalent to the desired number of copy sets. Thus, increased document handling is necessitated for a precollation copying system, as compared to a post collation copying system. Therefore, maximizing document handling automation while minimizing document wear or damage is particularly important in precollation copying.

In contrast, in a postcollation copying system, such as with an ADH or SADH, plural copies may be made at one time from each document page and collated by being placed in separate sorter bins. Thus, the document set need only be circulated (or manually or semiautomatically fed) to the imaging station once if the number of copy sets being made is less than the number of available sorter bins. A disadvantage is that the number of copy sets which can be made in one document set circulation is limited by the number of available sorter bins. Also, a sorter adds space and complexity and is not well suited for on-line finishing. However, postcollation copying, or even manual document placement, is desirable in certain copying situations to minimize document handling, particularly for delicate, valuable, thick or irregular documents, or for a very large number of copy sets. Thus, it is desirable that a document handler for a precollation copying system be compatible with, and alternatively usable for, post-collation and manual copying as well.

The art of original document sheet handling for copiers has been intensively pursued in recent years. Various systems have been provided for automatic or semiautomatic feeding of document sheets to and over the imaging station of the copier for copying. The documents are normally fed over the surface of a transparent platen into a registered copying position on the platen, and then off the platen. Such automatic or semiautomatic document handlers eliminate the need for the operator to place and align each document on the platen by hand. This is a highly desirable feature for copiers. Document handlers can automatically feed documents as fast as they can be copied, which cannot be done manually with higher speed copiers, thus enabling the full utilization or productivity of higher speed copiers.

The present invention overcomes various of the above-discussed problems of signature printing for copiers and provides various of the above features and advantages.

A feature of the specific embodiment disclosed herein is to provide an apparatus for signature printing with an automatic duplexing copier by simultaneously presenting plural document sheets to the imaging station of the copier in a predetermined page order for producing sets of signature copy sheets with copies of said plural document sheets thereon for folding said copy sheets into page order signature sets comprising:

automatic document reordering and presenting means associated with said copier and adapted to receive a set of document sheets loaded therein in normal serial page order, said automatic document reordering and presenting means including means for automatically reordering said document sheets from said normal sequential page order into a signature order of two predetermined nonsequential page orders, for automatically presenting said reordered document sheets to said imaging station two at a time in signature pair order for automatic duplex copying in copying cycles to automatically provide automatically duplexed signature copy sheets in signature sets as the output of said copier without requiring manual reordering of either the document sheets or the signature copy sheets.

Further features provided by the system disclosed herein, individually or in combination, include those wherein said automatic document reordering and presenting means includes means for automatic rotation of selected said document sheets after they are loaded therein and before they are first presented to be copied for correct page orientation signature copy production with said automatic duplexing copier;

including document feeding means fed reordered documents by said automatic document reordering and presenting means for simultaneously automatically presenting two said reordered document sheets at a time endwise (short-edge-first) to said imaging station in proper signature pair page relation in a copying cycle of said copier for copying onto one side of a single copy sheet to form one side of a signature copy sheet;

wherein said automatic document reordering and presenting means is operatively connected to document feeding means for sequentially presenting two document sheets at a time to said imaging station sideways (long-edge-first) in signature pair order for copying onto one side of a single copy sheet in a copying cycle of said copier to form one side of a signature copy sheet;

wherein said automatic document reordering and presenting means further includes a dual mode recirculating document feeder on said copier with a common document loading tray for automatically recirculating original document sheets in signature page order to and from said imaging station of said copier, from and back to said common tray, for the production of precollated book sets of signatures, said dual mode recirculating document feeder including repositionable rear stack edge guide means in the rear of said tray, common central sheet feeding means in the front of said common tray for feeding document sheets out of said tray to said imaging station, and a repositionable thin central divider positionable centrally in said common tray to provide a document stack separator in a vertical plane in the direction of feeding of said common sheet feeding means and centrally intersecting said common sheet feeding means, said rear guide means and said central divider being positionable in a first mode of operation so that two stacks of document sheets may be loaded into and feed from said common tray endwise, and so that individual document sheets from both stacks are automatically fed simultaneously and closely adjacent one another endwise by said common sheet feeding means, and, for a second mode of operation, said rear guide means and said central divider being alternatively repositionable for loading a single stack of document sheets lengthwise in said common tray and feeding said document sheets lengthwise from said lengthwise stack with said common sheet feeding means, and common restacking means for restacking said documents sheets in said common tray in the same orientation in which they were loaded therein after they have been copied at said imaging station;

wherein said automatic document reordering and presenting means includes document selector means for selecting predetermined document pages in a predetermined series, and selectable page rotator means for automatically rotating by 180° selected documents; and recirculative feeder means operatively connected to receive said selected and rotated documents from said document reordering and presenting means, for recirculatively presenting selected successive document page pairs in signature pair orientation and order to said imaging station of said copier and for returning them to said recirculative feeder means for recirculating for precollation copying;

wherein said automatic document reordering and presenting means includes integral automatic document feeding means for automatically presenting and representing document sheets in signature pairs to said imaging station of said copier for plural sequential copies thereof, and wherein said apparatus for signature printing further includes copy sheet collection and compilation means at the output of the copier coordinated with said automatic document feeder to provide collated signature set books in book page order automatically at said collection and compilation means;

wherein said copier has recirculating document feeding means, and said automatic document reordering and presenting means is an independent modular unit which automatically loads reordered documents into said automatic document reordering and presenting means in document order for plurally recirculating reordered original document sheets therein in signature page order to and from said imaging station of said copier for the automatic production of plural precollated book sets of signature;

wherein said recirculating document feeding means includes means for automatically inverting duplex document sheets for copying both sides thereof, and said automatic document reordering and presenting means includes rotating means for rotating by 180° alternate pairs of documents relative to the other document pairs;

wherein said automatic duplexing copier comprises a single imaging surface and duplexing means for automatically turning over and representing said signature copy sheets to said same imaging surface before outputting said signature copy sheets from said copier for automatically copying said document sheets onto both sides of said signature copy sheets;

further including modular center-folding and saddle-fastener means operatively connecting with the output of said signature copy sheets by said copier to compile and center-stitch therein said collated signature sets;

further including a modular center-folding and saddle-fastener unit operatively connecting with said copier output of said signature copy sheets, wherein said center-folding and saddle-fastener unit center-folds each copy sheet adjacent the output of the copier individually in the direction of movement of the copy sheets and automatically accumulates booklets of collated signature sets of collated output copy sheets from the output of said copier for on-line saddle-fastening finishing, said center-folding saddle-fastener unit having automatic on-line means for roof-shaped compiling said folded copy sheets into booklet sets, and means for center-saddle-fastening together said copy sheets of each such compiled booklet set; or in the method of signature printing with an automatically duplexing copier by presenting plural document sheets to the imaging station of the copier in a predetermined nonserial page order for producing a set of signature copy sheets comprising copies of said plural document sheets in signature page order, suitable for subsequent center-folding of said set of signature sheets into page order signature sets, the improvement comprising the steps of:

loading a set of document sheets into an automatic document reordering and presenting system associated with said copier in normal serial (nonsignature) page order, automatically reordering said set of document sheets with said automatic document reordering and presenting system into a predetermined nonserial reordered page order for signature page order copying for collated signature set output from said copier, and automatically presenting pairs of said reordered document sheets to said imaging station to be copied in said reordered page order from said automatic document reordering and presenting system so as to provide plural completed page order signature sets automatically with said copier without requiring any manual reordering of either the document sheets or the signature copy sheets;

wherein said automatic reordering step includes automatic rotation of selected document sheets after said loading step and before said step of presenting them to be copied to provide proper orientation of document pages for said automatic duplex copier;

wherein said document sheets are automatically separated into two stacks in said automatic reordering step by said automatic document reordering and presenting system, and two document sheets at a time are simultaneously presented lengthwise (short-edge-first) in parallel to said imaging station for copying from said two stacks, in the page relationship to one another of adjacent pages of a signature sheet;

wherein two document sheets are presented sequentially to said imaging station sideways (long-edge-first)

to be simultaneously copied at said imaging station to form the adjacent pages of a signature copy sheet;

wherein signature sheets are made by copying one pair of document sheets at a time at said imaging station onto one side of a signature sheet to make one signature page side in each copying cycle of said copier and then the next order signature page is made from the next pair or reordered document sheets, said reordered document page pairs being automatically plurally, recirculatively copied to automatically produce plural precollated, pregathered quires in book page order as the copier output without requiring a collator or collation of the copier output;

wherein said automatic reordering step includes automatic rotation of alternate pairs of document sheets after said loading step and before they are first presented to be copied; or wherein signature sheets are made by copying one pair of document sheets at a time at said imaging station onto one side of a signature sheet to make one signature page side in each copying cycle of said copier and then the next order signature page is made from the next pair of reordered document sheets, said reordered document page pairs being plurally recirculatively copied to automatically produce precollated pregathered, quires in book page order as the copier output without requiring a collator or collation of the copier output.

Some examples of various other prior art copiers with document handlers, and especially with control systems therefor, including document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in this art, and in general, how to program and execute document handler and copier control functions and logic with conventional or simple software instructions for conventional microprocessors. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document handling functions and controls may be alternatively conventionally provided utilizing various other known or suitable logic or switching systems.

All references cited in this specification, and their references, are incorporated by reference herein where appropriate for appropriate teachings of additional or alternative details, features and/or technical background.

Various of the above-mentioned and further features and advantages will be apparent from the specific apparatus and its operation described in the examples below. The present invention will be better understood by reference to this description of these embodiments thereof, including the drawing figures (approximately to scale), wherein.

Figure 1:
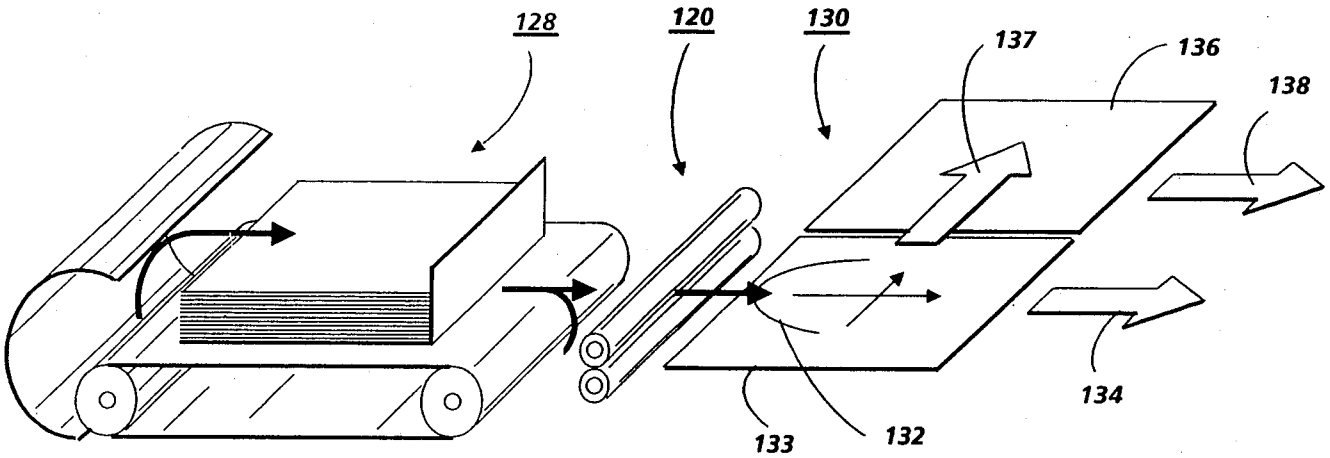
FIG. 1 is a simplified schematic example of an automatic signature pair document reordering and presenting system in accordance with the present invention.
Figure 12:
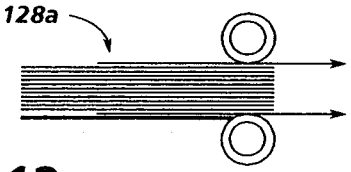
Figure 3A:
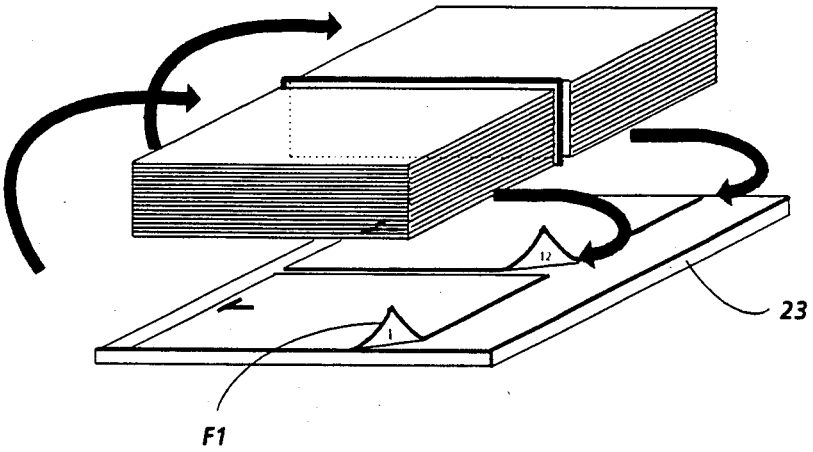
Figure 3B:
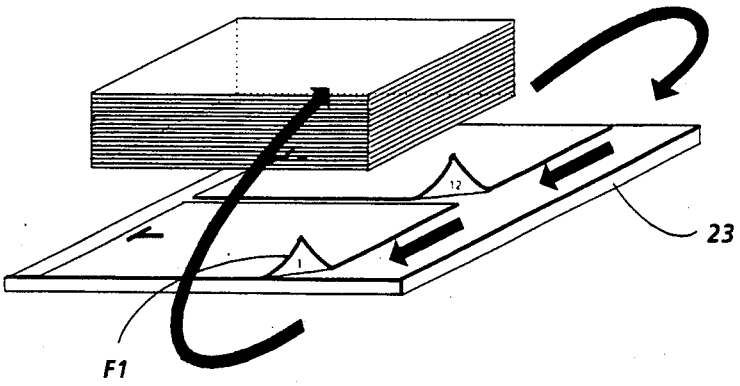
Figure 4:
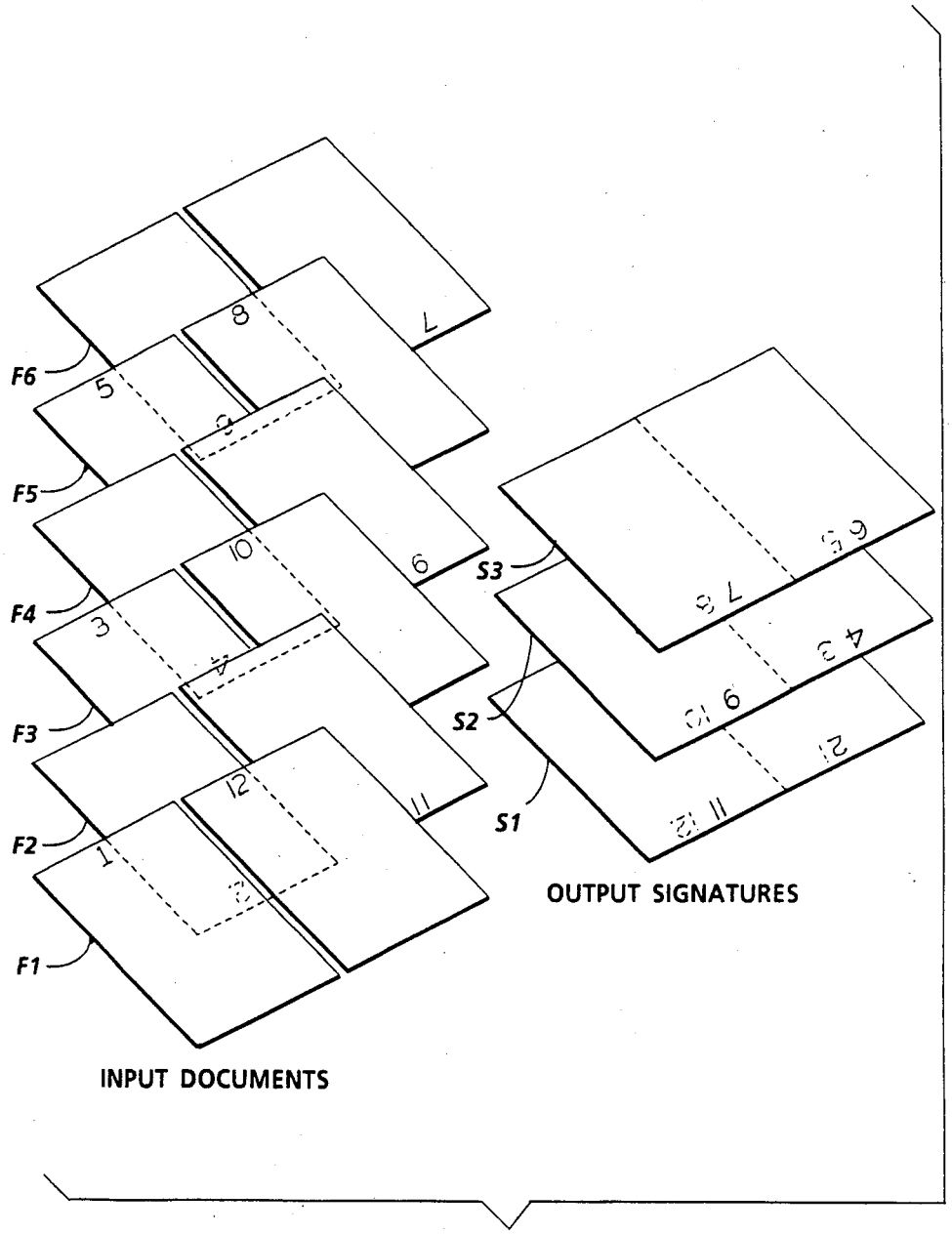
Figure 5:
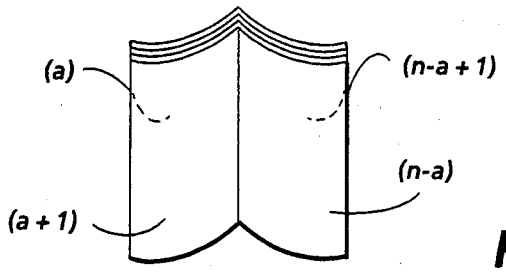
Figure 6:
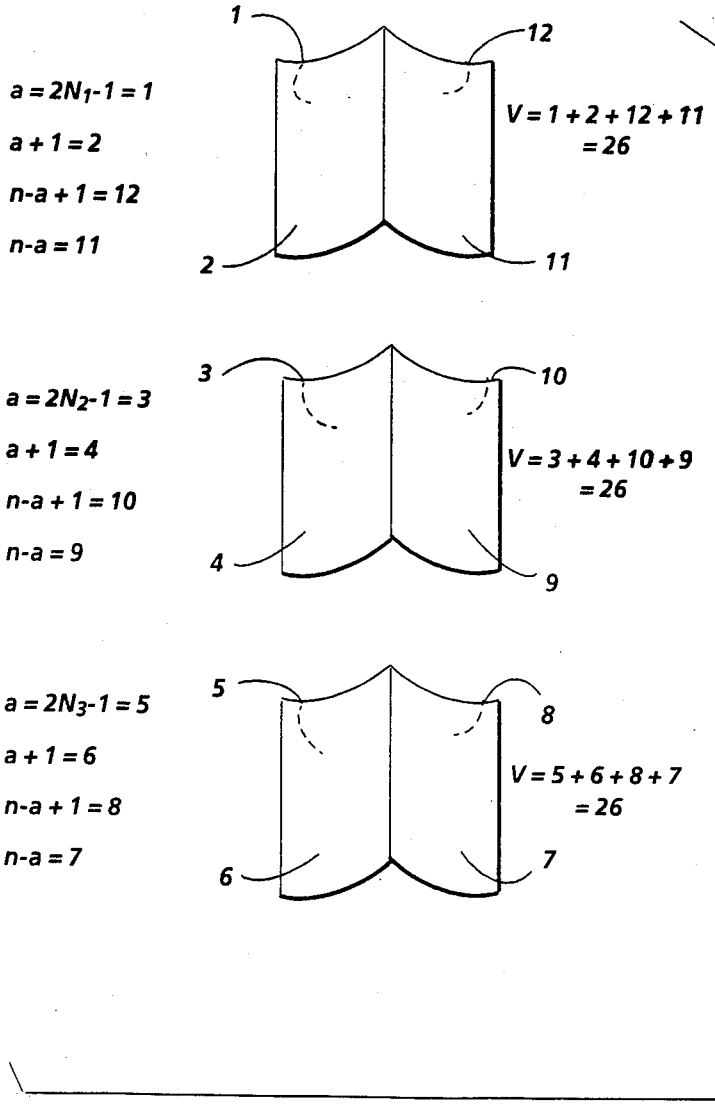
Figure 8:
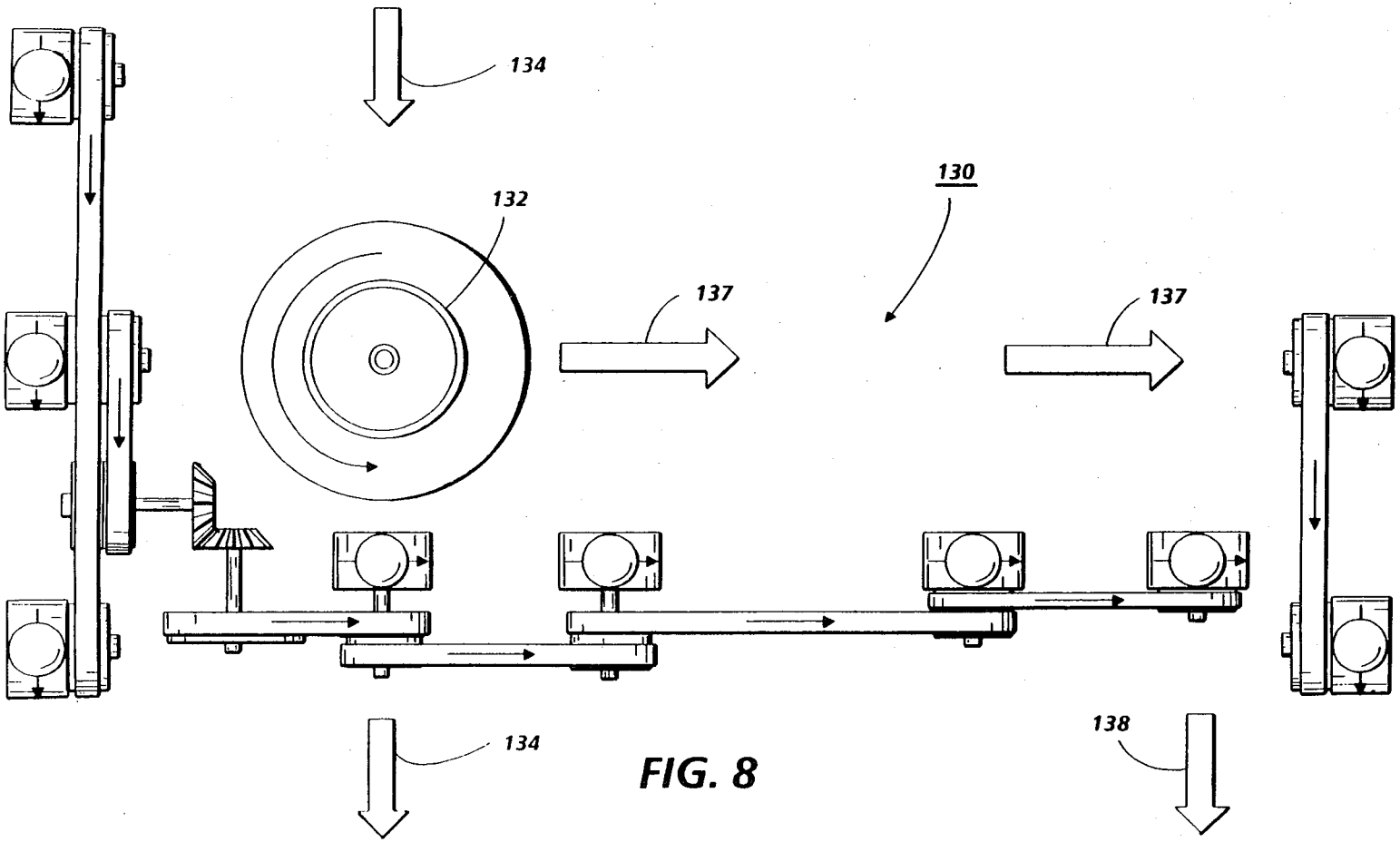
Figure 9:
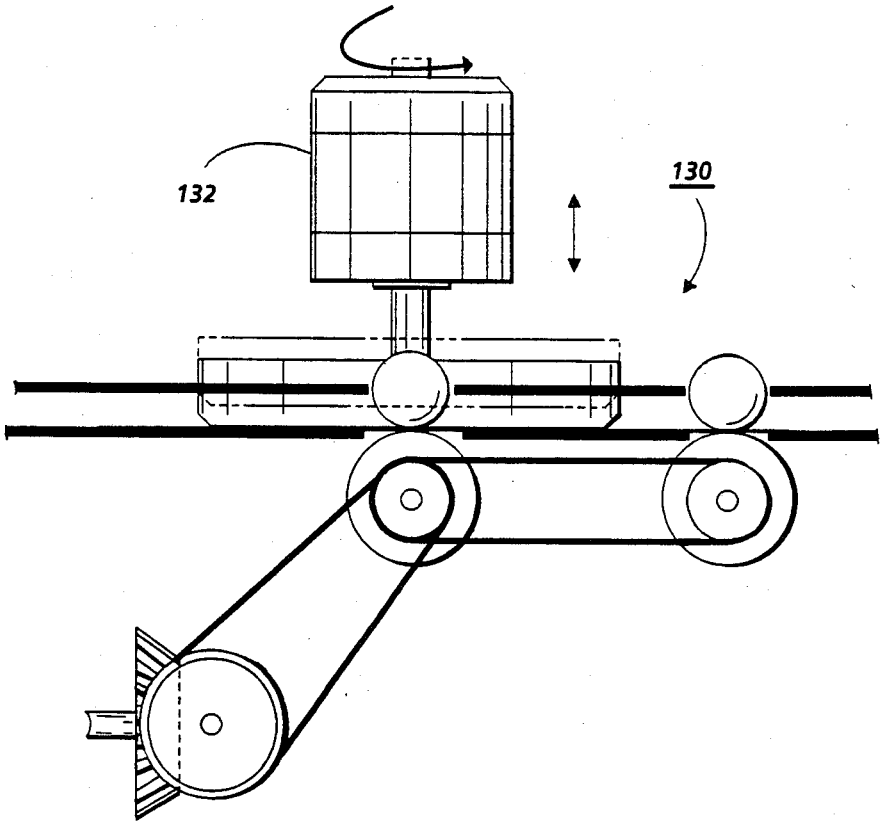
Figure 10:
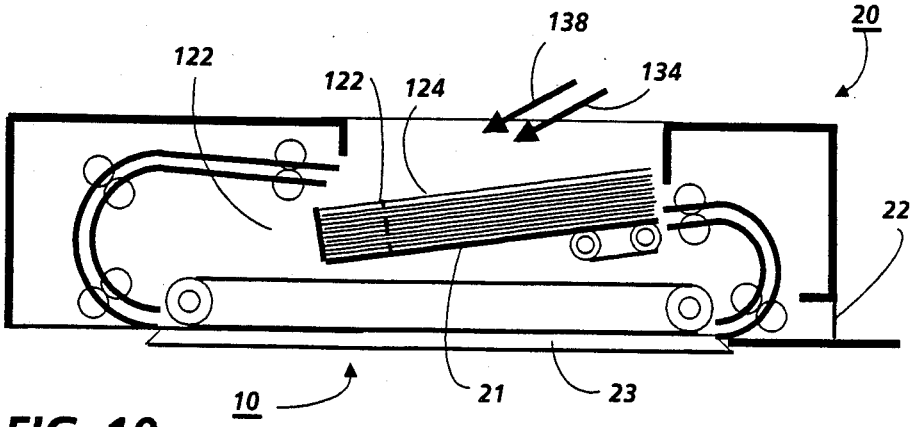
Figure 11:
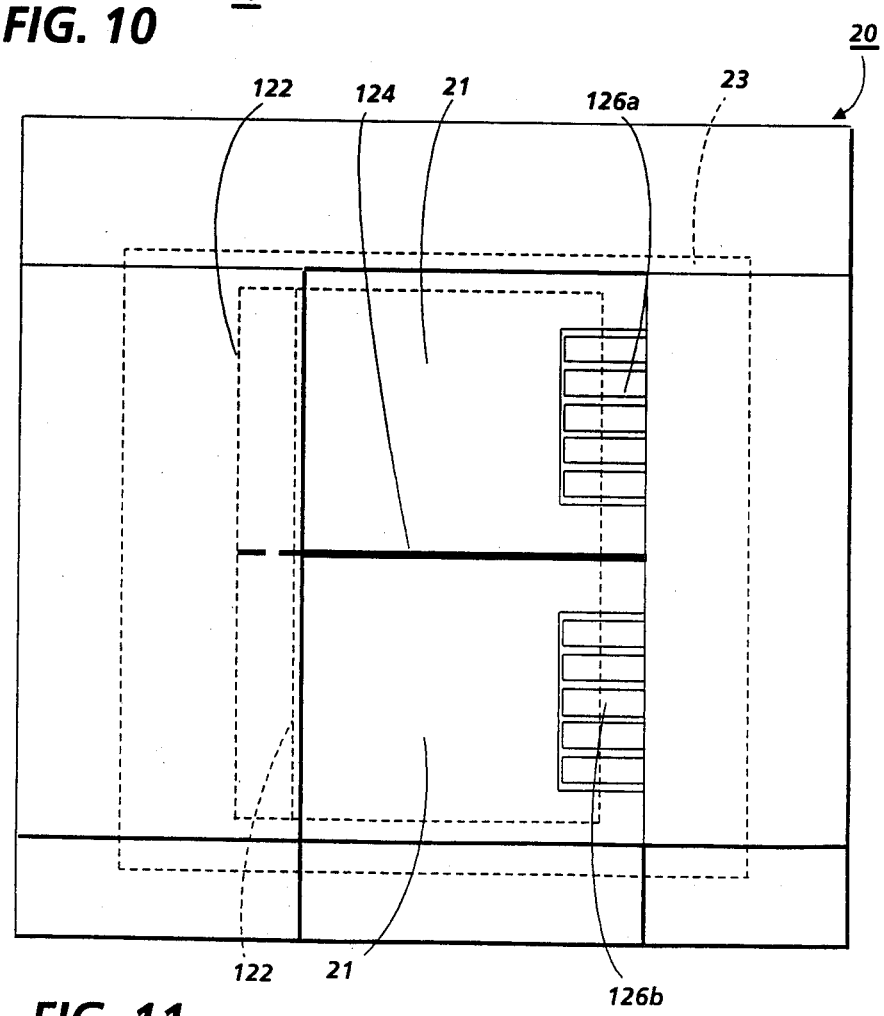

FIGS. 3*a* and 3*b* are schematic illustrations of two different modes or paths of presenting documents to the platen, i.e., in pairs short-edge first from two stacks to one side of the platen, or sequentially long-edge first from one stack to the front or back of the platen;

FIG. 4 illustrates simplex document pair input on the left relative to signature copy sheet output on the right, for the production of a page-correct 3 signature booket on a coper, shown with the document sheets face-up, for clarity, and the page numbers at the tops of the pages;

FIG. 5 is an illustration of algebraic page numbering for each individual signature as discussed herein, facing inside-open;

FIG. 6 is an example of folding and page numbering for a three signature booklet, facing inside-open; and FIG. 7, labeled "Prior Art", illustrates the previously described "Xerox 7000 Signature Maker" document signature pair slide rule calculator, in one exemplary slide-out position. [The illustrated lighter numbers are on the slide member, and the darker numbers and the two windows are on the stationary member, and the only numbers that "show" from the two top rows are the numbers in the windows];

FIGS. 8 and 9 are respective top and side views of an exemplary apparatus for the reordering and presenting system of FIG. 1, et al:

FIGS. 10 and 11 are respective separate side and top views of an exemplary automatic and dual mode document handler for the system of the invention; and FIG. 12 is an alternative, alternate top and bottom feeding, document separator/feeder for the document reordering and presenting system of FIG. 1.

Describing now in further detail the specific example illustrated in the Figures, there is shown a copier 10 with a document handling system 20, preferably an RDH to be described herein somewhat similar to that disclosed in the above-cited U.S. Pat. No. 4,469,319, etc., but modified and adapted for a document pair feeding, for sequentially transporting pairs of document sheets simultaneously onto and over the conventional platen imaging station 23 of the copier 10.

The document handling system 20 illustrated here is exemplary, and may be readily modified for different copiers. It has two separate document inputs, a recirculating or RDH input stacking tray 21 on top, and an SADH side entrance 22 for semiautomatic document handling, especially for larger documents, which may be optionally inserted short edge first there. This document handling system 20 here is particularly adapted to automatically feed and register signature pairs of document sheets at the appropriate registration (copying) position on the platen 23, and to repeatedly recirculate them in pairs, without disturbing their page order.

Figure 2:
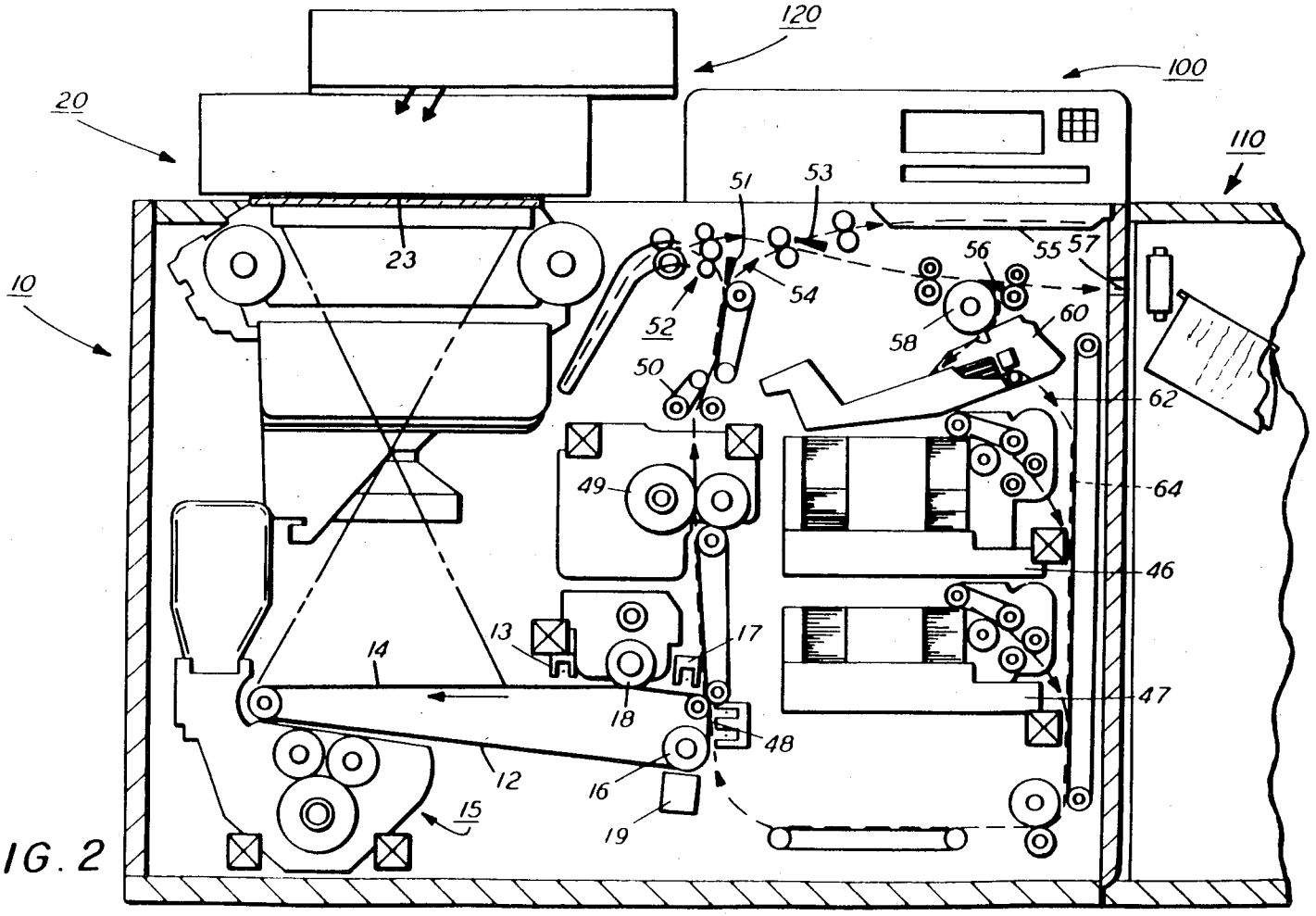
FIG. 2 is a front view of one example of the present invention as a part of and utilizing an exemplary commercial xerographic automatic duplexing copier.

Other than the document pair input system, the output system, and controls to be described, the exemplary copier 10 shown in FIG. 2 is a front view of the well known "Xerox" "1075" or "1090" xerographic copiers which provide automatic duplex copying, as illustrated and described in patents cited above, including U.S. Pat. No. 4,278,344 and others.

The exemplary copier 10 of FIG. 2 will now be briefly described. The copier 10 conventionally includes a xerographic photoreceptor belt 12 and the xerographic stations acting thereon for respectively corona charging 13, image exposing 14, image developing 15, belt driving 16, precleaning discharge 17 and toner cleaning 18. A densitometer 19 control may also be provided. Documents on the platen 23 are imaged onto the photoreceptor 12 through a variable reduction ratio optical imaging system to fit the document images to the selected size of copy sheets.

The copier 10 is adapted to provide duplex or simplex precollated copy sets from either duplex or simplex original documents copied from the same RDH 20. Two separate copy sheet trays 46 and 47 are provided for feeding clean copy sheets from either one selectably. They are referred to as the main tray 46 and auxiliary tray 47.

The control of all sheet feeding is, conventionally, by the machine controller 100. The controller 100 is preferably a known programmable microprocessor, exemplified by the previously cited art. The controller 100 conventionally controls all of the machine steps and functions described herein including the operation of the document feeder 20, the document and copy sheet gates, the feeder drives, etc. AS further taught in those references, the controller 100 also conventionally provides for storage and comparison of the counts of the copy sheets, the number of documents recirculated in a document set, the desired number of copy sets and other selections by the operator through the panel of switches thereon, time delays, jam correction control, etc.

The copy sheets are fed from the selected one of the trays 46 or 47 to the transfer station 48 for the conventional transfer of the xerographic toner image of document images from the photoreceptor 12 to the first side of a copy sheet. The copy sheets are then fed by a vacuum transport to a roll fuser 49 for the fusing of that toner image thereon. From the fuser, the copy sheets are fed through a sheet decurler 50 to a gate or deflector finger unit 51 which functions as an inverter selector. Depending on the position of the gate 51 the copy sheets will either be deflected into a copy sheet inverter 52 or bypass the inverter 52 and be fed directly onto a second pivotal decision gate 53. Those copy sheets which bypass the inverter 52 turn a 90° corner path 54 in the sheet path which inverts the copy sheets into a last-printed face-up orientation before reaching a second gate 53. That is, the image side which has just been transferred and fused is face-up at this point. If the inverter 52 sheet path is selected instead (by gate 51) the opposite is true (the last-printed sheet face is face-down at this point).

This second decision gate 53 then either deflects the sheets directly into an output tray 55 or deflects the sheets into a transport path which carries them on without further inversion to a third decision gate 56. If this third gate 56 is down it passes the sheets directly on without inversion into the output path 57 of the copier. If gate 56 is up it deflects the sheets into a duplex inverting transport 58. The inverting transport (roller) 58 inverts and then stacks copy sheets to be duplexed in a duplex buffer tray 60.

The duplex tray 60 provides intermediate or buffer storage for those copy sheets which have been printed on one side and on which it is desired to subsequently print an image or images on the opposite side thereof, i.e. copy sheets in the process of being duplexed. Due to the sheet inverting by the roller 58, these buffer set copy sheets are stacked onto the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (blank) sheets from the trays 46 or 47. It may be seen that this copy sheet feed path 64 between the duplex tray 60 and the transfer station 48 has an inherent inversion which inverts the copy sheets once. However, due to the inverting transport 58 having previously stacked these buffer sheets printed face-down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 to be stacked in tray 55 or fed out into the output path 57.

The output path 57 preferably transports the finished copy sheets directly into the connecting, on-line, modular, finishing station 110. There the completed precollated copy sets may be finished by stapling, stitching, gluing, binding, and/or offset stacking in the module 110. Suitable details are described in the finishing references previously cited above. Especially those cited patents disclosing center-folding and center-stapling or stitching to provide collated signature set booklets, preferably with a "roof"-type compiler for the roller-folded sheets, as shown.

As is known from the prior art, to make signatures assembled into booklets, each signature generally comprises four pages of images of four document pages, usually copied from 4 simplex documents, but it can be from 2 duplex documents. Two documents are laid side-by-side on the platen and exposed to make side-buside images on one side of the first copy sheet. The copy sheet is temporarily stored in a suitable duplex buffer receptacle and two other documents are placed side-by-side on the platen. These next two documents are exposed, and these side-by-side images placed on the opposite side of the first copy sheet forming a signature sheet which can form part of a booklet when folded in half. This signature contains four pages or images, and when folded toghether and nested with other appropriately paged signatures will form a complete booklet.

For clarity of the discussion herein, it will be assumed or considered that the first page or front cover of each signature set or "book" is page "1", although in commercial practice the actual printed page number "1" is normally on the third page, and first inside signature sheet, of the book and therefore on the second signature sheet. Likewise, the last copy page of the "book" or chapter is assigned here a last page number for processing purposes, even though of course, this last page is often actually blank and unnumbered, especially if there were an odd number of original pages for that book or chapter.

For the simplest case, a single sheet (one signature) signature set, the outside pages are 1 and 4, and the inside pages are 2 and 3. Center-folded, this makes a book of 4 pages; 1,2,3,4.

Taking, for one example, a 20 "page" original to be signature printed onto a single quire (single signature set) booklet, this would require 5 copy sheets to make 5 signatures from these 20 pages of originals for each said booklet. The first (bottom, cover, or outside) signature sheet must be printed on its outside with page 20 on its *left end (or ultimate back side) and page 1 on its right* end (or ultimate front side). The obverse or inside of this same first signature sheet must be printed with page 2 on the left end and page 19 on the right end as it is facing towards the reader. This may be abbreviated as 20-1/2-19. The second signature in this example must be printed 18-3/4-17. The third signature is 16-5/6-15. The fourth is 14-7/8-13. The fifth, which here is the inside (innermost) signature, is printed 12-9/10-11.

Note that in each case each page on one end of a signature is one page number different from the page number on the same end but opposite side of the same signature, to provide consecutive page numbers when the signatures are center-folded into a booklet. However, the numbers on one end of the respective signatures are ascending (increasing) serially and those on the other end are descending (decreasing) serially.

FIG. 4 illustrates document pair F1 (pages 12 and 1) being the first input document pair to be imaged on the underside of copy sheet or signature sheet S1, shown with the dashed-line page numbers 1 and 12. The next document pair F2 (pages 11 and 2) is imaged on the top side of copy sheet S1, forming the first signature. Similarly, document pairs F3 and F4 are imaged on copy sheet or signature S2 with the images of document pair F3 being on the underside. Document pairs F5 and F6 are imaged on signature S3. The final booklet of 12 pages comprises signatures S1, S2, and S3 with the relative positions of the images of documents pages 1–12 as shown.

Note that, as described above re the "1090" copier signature printing, the document pairs F1–F6 would, of course, be face-down on the platen, not face-up. (As they are fed onto the platen by the document feeder 20 they are turned over.) For pair F1 the tops of the document pages face the left side of the platen; for F2 the right side, etc., i.e., with each pair alternating in directions by 180°. Also, the higher page number of each pair, will be at the back of the platen.

In FIG. 4 the signature output is shown unfolded. In FIG. 6 it is shown folded by finisher 110, but partially opened, and in perspective, for drawing clarity. Note that in FIGS. 5 and 6 the inside of each signature is facing towards the observer and the outside is facing away, with the center fold or spline directed away from the reader. I.e., the signatures are being opened "face-up" towards the reader as they normally are when a booklet is opened, and as if the sheets were standing up.

The difficulty in producing the booklets of signatures is the page ordering and the sequence and orientation of placing the documents on the platen in order to have consecutive pages or images in the final booklet. These difficulties have been described near the beginning of this specification, especially the document rotation requirements. However, the page ordering requirements will be addressed first here.

In accordance with the system taught in the copending Bober, et al application cross-referenced at the beginning of this specification, the pagination of some typical signature (Ni) is shown in FIG. 5. Assuming:

N=Total Number of Signatures in the set or booklet, then n=4N where n=total number of pages (including required blanks) in the booklet.

Also, $N=n_{D/4}$ (rounded up to an integer if necessary), where $n_D$ is the total number of single page documents determining the total number of signatures N *required.*

With these definitions, the page numbers of any given signature $N_i$, (where $N_1=1$; $N_2 2$, etc.) are given by the following equations:

For the first page number "a", $a=2N_1-1$, where "a" is illustrated in FIG. 5 as the page on the left side of the outside (here the underside) of the signature $N_1$.

The right page on the underside is $(n-a+1)$

The left and right inside (face up here) pages are $(a+1)$ and $(n-a)$, respectively.

It can also be seen that the total number of pages (n) or faces (after folding) is set by the number of signatures such that:

$n=n_D$ plus (0, 1, 2, 3) such that n is a multiple of four.

A useful property of signature pagination is, that for all of the signatures, there exists a unique page number total of the four pages contained on any of the signature in that set, i.e., $V=2(n+1)$ where V=the total value of page numbers for any signature.

This can be used to check the pagination on each signature. By comparing the check value V to the page total for each signature, the controller or operator can easily verify that the pagination is correctly done.

For example, in FIG. 6 there is shown an exploded view of a sample three signature, 12 page, booklet, and the calculation of the correct page number and the correct check value for each signature 1, 2 and 3. As illustrated in FIG. 6, there must be four correct page numbers for each signature, two of the page numbers inside or facing up and two of the page numbers outside or facing down. As shown in FIG. 5, the two outside page numbers are (a) and $(n-a+1)$, where $(a=2N_1-1)$. The two inside page numbers are $(a+1)$ and $(n-a)$. By substituting the correct values of a and n in these formulas for each signature, the correct value or page number is determined. That is, since here N=3 (3 signatures), then n=4N=12. Also, since $a=2N_1-1$, for signature 1 or $(N_1)$, then $a=2(1)-1=1$. By use of these expressions, as shown in FIG. 6, it can be seen that for the outermost signature $N_1$, the outside page numbers are 1 on the left and 12 on the right and the inside page numbers are 2 on the left and 11 on the right. For signature $N_2$, to be nested into $N_1$, the correct outside page numbers are page 3 on the left and page 10 on the right, and for the inside pages, number 4 on the left and number 9 on the right. Similarly, for signature $N_3$, the page numbers outside, or down, are 5 and 8 and the page numbers inside, or up, are 6 and 7. It can be seen, therefore, that, properly assembled, the three signatures will properly give sequential consecutive pages 1 through 12 in a signature set or booklet. For each signature, substituting the total number of pages n=12 in the formula for the check value, V, $V=2\ (12+1)=26$. It can be seen that for each signature the total value of page numbers and the checkvalue equals 26.

Alternatively, the "7000" "slide rule", or the "1090" "look up" tables, previously described here can be preprogrammed into the copier controller, preferably into a ROM, PROM or other nonvolatile memory table to select the document pair page orders.

A further description will now be provided of the automatic document reordering and presenting system, particularly the example 120 thereof disclosed herein schematically in FIG. 1 and in further detail in FIGS. 8 and 9, etc. For convenience, this will be further referred to herein as the ADRP 120. The ADRP 120 is preferably a modular unit and may be mounted on top of a multiple function document handling unit 20 as illustrated in FIG. 2. The ADRP 120 module is shown in FIG. 2 mounted over the RDH 20, partially offset, and rotated 180 degrees relative to the FIG. 1 orientation, for overall compactness. It may alternatively be positioned so as tofeed documents to various types of document handling units from either the one side or one end, as will be further described, and as schematically illustrated in FIG. 3*a* vs. 3*b*. The particular ADRP system will depend on whether the documents are being presented to the platen in short-edge-first signature pairs or sequentially fed long-edge, as illustrated respectively in FIGS. 3*a* and 3*b*. The short-edge-first simultaneous signature pair feeding of FIG. 3*a* is preferred, and is illustrated in FIGS. 1, 8, 9, etc. As will be described, this is compatible with a dual mode document handler 20 as illustrated in FIGS. 10–11. I.e., a document feeder 20 is conventionally adapted to feed individual documents long-edge-first from the sides of the platen, but which for signature pair feeding is also specially adapted to feed signature pairs short-edge-first in the same document handler to the same side of the platen. The alternative in FIG. 3*b* of feeding documents long-edge-first from the front or back of the platen is feasible but not conventional, i.e., this is not the normal feeding direction of conventional document handlers.

Preferably, the ADRP 120 feeds document pairs into the recirculating document handler 20 after they have been properly page ordered and rotated, so that the circulating document handler 20 can provide recirculative or precollation copying of the documents, thereby automatically providing as many precollated signature sets of the output as desired, fully automatically, without requiring any subsequent collation or reordering of the signature copy sheets. A pair-feeding RDH 20 is shown in FIGS. 10 and 11. This recirculating document handler may operate in an otherwise conventional manner in accordance with the numerous above-cited patents describing RDH operations both as to the details of the RDH and also as to the manner of copying. For example, recirculative copying of simplex originals automatically to produce collated duplex copies therefrom simply by selecting the simplex/duplex copying mode switch on the controller 100. As shown in both FIGS. 10 and 11, preferably the RDH 20 has a large input tray 21, capable of dual mode operation for either conventional long-edge-first document recirculating or short-edge-first pairs feeding. In the latter case, the back or rear stop 122 of the tray 21 is in its rear-most position as illustrated in solid lines, and in the former mode it is moved further toward the front feeder into the illustrated dashed-line position. For the pairs-feeding mode preferably a removable center divider 124 is provided centrally of the tray 21 extending in the directionof the short-edge-first feeding of the two sheets. The center divider 124 is, of course, removed for conventional document feeding. When pair-feeding is being done the center divider 124 prevents skewing of the documents as they are fed. The divider 124 also assists in the proper restacking of the pairs of documents into their two separate respective stacks in the tray 21. To further assist in pairs-feeding in the document handler 20, the otherwise conventional corrugating vacuum feeder 126 is either extended, or provided in two separate units 126*a* and 126*b*, as illustrated. The corresponding air knives operatively associated therewith may also be so separated. This provides a more centralized, nonskewing, simultaneous individual feeding of the two sheets from the bottom of the two stacks. Yet it also still provides feeding with both feeding units 126*a* and *b* of large documents fed long-edge first from the same tray 21. As previously noted, the DH 20 may conventionally also have a SADH entrance 22 for straight-through feeding from the side of the document handler onto the platen and off. This may be conventionally utilized for large documents. However, the SADH entrance may also be utilized for pair-feeding 22 directly from the ADRP 120 if desired. E.g., if the document pairs are not suitable for normal RDH recirculation and precollation copying from the tray 21 and back through the recirculative path of the RDH 20.

Although the ADRP 120 is illustrated as a separate module, this need not necessarily be the case. The ADRP 120 may be built into, as an integral part of, the RDH 20, or an SADH, or other document feeder. For example, a document rotator such as shown in FIG. 9 may be built directly into a diverter path or channel of an RDH. Alternatively, the ADRP 120 may itself provide all of the document handling, particularly if no recirculation is required. That is, the system 120 illustrated in, for example, FIGS. 1, 8 and 9 may feed the documents directly onto the platen in signature pairs for copying.

Referring now to the operation of the ADRO 120 in FIGS. 1, 8 and 9, as previously explained, it functions to take a normally collated, conventional, single set of document sheets loaded therein and to automatically reorder those document sheets from their normal sequential page order into a signature order, and to put the document sheets in proper signature pair page order for subsequent automatic signature copying on a copier without requiring any manual reordering of either the document sheets or the signature copy sheets. This same automatic document reordering and presenting apparatus 120 also includes automatic document rotation apparatus for simplex documents for rotating the proper, selected, simplex document sheets so that they will be in the correct top to bottom page orientations for copy production on automatic duplexing copiers with long-edge-first copy sheet feeding, as discussed in the introduction.

FIG. 1 provides a schematic view with movement arrows for the document sheets to illustrate the operation. The counting and selection and movement of the documents may be by conventional clutch-actuated feeding rollers or the like, all controlled at the appropriate document sheet count by the controller 100. For simplicity of illustration, the separate clutches for actuating at proper times the separate driving sections in orthogonal feeding directions are not identified, since this is a well known ball-on-roller type feeding system. As previously indicated, the particular document selected to be fed out and rotated is determined by the known copying algorithm for signature pair printing which is known and readily programmable from the information previously discussed in connection with both the prior art and the descriptions of FIGS. 4–7 herein. Using these known desired algorithms for page pairs the ADRP 120 provides automatic presorting of the proper page pairs and their sequencing and rotation into the proper position for presentation to the platen. The ADRP 120 illustrated here also provides the capability for transporting the signature paris in parallel directly to the platen, or, as described, to a dual tray or a split tray document handler 20 as previously described. If fed directly to the platen, they would preferably be loaded into the ADRP unit 120 face down and fed out face down, or an inverter could be provided. For loading the output of documents from the ADRP 120 into a normal over-platen RDH, which normally inverts documents before they are copied, the input and output of the ADRP 120 is preferably face up, as shown.

The ADRP 120 here first accepts the stack of normal order document sheets in the tray of a random access separator/feeder 128. This unit 128 operates somewhat similarly to a normal RDH, including a conventional sheet counter, except that as the documents are being recirculated and counted, as the unit 128 comes to the document it wants to then feed out, in accordance with the signature algorithm instructions, it does so, and then continues to recirculate the sheets of the stack until the next document sheet selected is being fed, and then ejects only that document, and so on. Thus, under the control of the copier microprocessor programming, the original document set is divided and reordered into the proper page sequence for signature printing. The random access separator/feeder 128 may be either 1 to N or N to 1 page order, and bottom or top feeding and top or bottom restacking, as are all known for RDH's.

In FIG. 12, a top and bottom stack feeder 128*a* is shown as an alternative to or direct substitute for the feeder 128. The sequence of feeding is the same. Document sheets are automatically alternately fed out from opposite sides of the original collated set or stack loaded into the unit. I.e., feeding a document sheet from the top, then one from the bottom, then one from the top again, etc., or the reverse sequence. This feeds out the first and last pages, then feeds out the second and the next to last pages, etc. The FIG. 12 reordering separator/feeder 128*a* differs in requiring two feeder/separators, as shown, one feeding from the top of the stack and one feeding from the bottom. It is capable of higher productivity because there are no delays for non-feed-out circulation of the set. No circulation is required in the unit 128*a*. A prior art example of a top and bottom document stack feeder, used for a different function, is described in U.S. Pat. No. 4,184,671 issued Jan. 22, 1980 to Y. Sasamori, and assigned to Rank Xerox Ltd.

The selected document sheets for this particular random access separator/feeder 128 are circulated and ejected short-edge-first into the downstream portion of the ADRP 120. There they are received by a bidirectional transport 130 to a first position 133. The bidirectional transport 130 includes an integral sheet rotator 132, at position 133. The bidirectional transport 130 acts to take sheets in the head-to-tail sequential order they are fed out by the random access separator/feeder 128 and to transport one of those document sheets straight forward or out of the unit as illustrated by the immediately adjacent first output arrow 134. However the bidirectional transport 130 also contains frictional wheel/ball drives of a known type in the orthogonal or right angle direction thereto, as illustrated. These move alternate document sheets laterally or sideways into a second position 136. This lateral movement to the second pair position is illustrated by the lateral arrow 137. There, those document sheets are also ejected, by another right angle drive portion of the plural-directional transport 130, in the same direction as output arrow 134, but parallel thereto as illustrated by the second output arrow 138. With this system, pairs of documents can be fed out simultaneously from both the first and second pairs positions 133 an 136 in the direction of movement of both the first and second output arrows 134 and 138, after they have been properly paginated for signature pair printing as previously described.

As described above, rotation of the head-to-tail orientation of successive signature pairs of simplex (not duplex) documents is also needed for automatic duplex copying. This is provided by the integral sheet rotator 132 at the first position 133 here. This sheet rotator 132 is particularly illustrated in FIG. 9. It may be of a type known per se for sheet rotation, utilizing a rotary solenoid or motor or cam to bring a frictional clamping surface against at least one side of the document sheet and then to rotate that frictional clamp by 180°, about an axis of rotation perpendicular to the sheet plant. This rapidly and automatically rotates the head to tail sheet, reversing it from head to tail. Further details of such a sheet rotator are discussed in the 1984 Xerox Disclosure Journal Publication cited above in the introduction here. This is done automatically for alternate pairs of the documents being fed out by the random access separator/feeder 128. That is, depending on the position of the ADRP relative to the platen, the first and second, then fifth and sixth, etc. documents will be rotated before being fed beyond the first position 133, or alternatively the third and fourth, then seven and eighth document sheets, etc.

Note that documents could alternatively be fed long edge first, or changed in their orientation, by using 90 degrees of rotation instead of 180 in the sheet rotator 132. Thus, a long edge first feeder 128 or 128*a* could alternatively be used, yet still provide short-edge-first pairs output.

Although not illustrated, it will be appreciated that conventional retractable, registration fingers or gates or other suitable known registration mechanisms may be utilized for the registration and alignment of the document sheets at positions 133 and 136 in the ADRP 120. They need not be illustrated here since they may be conventional, such as those used for registration of documents on the platen of a copier. If desired, an inverter can also be provided in the ADRP for turning the documents over. However, by the selection of the appropriate type of random access signature feeder 128, in which the facing or stacking and/or the placement of the document stack therein provides the desired face-up or face-down output from the ADRP 120, an inverter is not required.

As previously noted, the automatic "2-up" copying provided by the ADRP 120 is preferably in simultaneous short-edge-first fed pairs, in FIG. 3*a*, but it is also possible to feed the pairs onto the platen from the front or back thereof long-edge-first, sequentially, as in FIG. 3*b*. In the latter case, the unit 128 could recirculate documents long-edge-first. Alternatively, the documents could be fed on to the platen by continuing their motion in the same direction as the lateral arrow 137, continuing on in that same direction beyond the second pair position 136 towards the platen. In this latter case the ADRP or its connecting documents feeding means is operated to sequentially present two document sheets at a time to the imaging station sideways (long-edge-first) in signature pair order. Note however, that the actual position and orientation of the documents as they are being copied on the platen in this alternative mode of operation of the ADRP 120 is the same as in the other mode (of simultaneous short-edge-first pairs feeding). However, in this alternative mode of sequential long-edge-first feeding the documents can be fed into and from a single stack RDH or SADH rather than a dual stack RDH or SADH. In either case, another alternative is for the first and second signature pair positions 133 and 136 to be directly on or over the platen itself.

As an additional feature, the modified RDH of FIGS. 10 and 11 may alternatively be utilized to feed a stack of small documents from one of the tray sectors with one of the feeders 126*a* or 126*b*. That is, this unit has utility for other than signature printing. Another utility is to feed small document sheets from one sector and feed a form or forms from the other sector to be integrated onto a single copy sheet.

It may be seen that the above-described ADRP system is fully automatic. All the operator has to do is drop a normal stack of documents in the single tray of the ADRP separator/feeder unit 128 and without any further operator intervention they will be automatically selected, reordered and orientated for proper 2-up signature printing. This order allows fully automatic production of signatures on an automatic duplex copier. It can present the signature pairs directly to the platen, or to the input of an automatic document feeder, preferably, a directly associated recirculating document handler providing automatic precollation copying to produce precollated signature sets ready for immediate on-line center-folding and binding into finished booklets.

By reversing the direction and operation of the ADRP separator/feeder unit 128, or its equivalent, it may be used to automatically take back and restack, into a single stack, in the original order, the documents after they are copied. That is, to reorder the documents from signature pairs order back into normal collated order.

While the embodiments disclosed herein are preferred, it will be appreciated from this teaching that various alternatives, modifications, variations or improvements therein may be made by those skilled in the art, which are intended to be encompassed by the following claims:

What is claimed is:

1. Apparatus for signature printing with an automatic duplexing copier by simultaneously presenting plural document sheets to the imaging station of the copier in a predetermined page order for producing sets of signature copy sheets with copies of said plural document sheets thereon for folding said copy sheets into page order signature sets comprising:

automatic documents recording and presenting means associated with said copier and adapted to receive a set of document sheets loaded therein in normal sequential serial page order, said automatic document reordering and presenting means including means for automatically reordering said document sheets from said normal sequential page order into a signature order of two predetermined nonsequential page orders, for automatically presenting said reordered document sheets to said imaging station two at a time in signature pair order for automatic duplex copying in copying cycles to automatically provide automatically duplexed signature copy sheets in signature sets as the output of said copier without requiring manual reordering of either the document sheets or the signature copy sheets.

2. The apparatus for signature printing of claim 1 wherein said automatic document reordering the presenting means includes means for automatic rotation of selected document sheets after they are loaded therein and before they are first presented to be copied for correct page orientation signature copy production with said automatic duplexing copier.

3. The apparatus for signature printing of claim 1 including document feeding means fed reordered documents by said automatic document reordering and presenting means for simultaneously automatically presenting two said reordered document sheets at a time endwise (short-edge-first) to said imaging station in proper signature pair page relation in a copying cycle of said copier for copying onto one side of a single copy sheet to form one side of a signature copy sheet.

4. The apparatus for signature printing of claim 1 wherein said automatic document reordering and presenting means is operatively connected to document feeding means for sequentially presenting two document sheets at a time to said imaging station sideways (long-edge-first) in signature pair order for copying onto one side of a single copy sheet in a copying cycle of said copier to form one side of a signature copy sheet.

5. The apparatus for signature printing of claim 1 wherein said automatic document reordering and presenting means further includes a dual mode recirculating document feeder on said copier with a common document loading tray for automatically recirculating original document sheets in signature page order to and from said imaging station of said copier, from and back to said common tray, for the production of precollated book sets of signatures, said dual mode recirculating document feeder including repositionable rear stack edge guide means in the rear of said tray, common central sheet feeding means in the front of said common tray for feeding document sheets out of said tray to said imaging station, and a repositionable thin central divider positionable centrally in said common tray to provide a document stack separator in a vertical plane in the direction of feeding of said common sheet feeding means and centrally intersecting said common sheet feeding means, said rear guide means and said central divider being positionable in a first mode of operation so that two stacks of document sheets may be loaded into and feed from said common tray endwise, and so that individual document sheets from both stacks are automatically fed simultaneously and closely adjacent one another endwise by said common sheet feeding means, and, for a second mode of operation, said rear guide means and said central divider being alternatively repositionable for loading a single stack of document sheets lengthwise in said common tray and feeding said document sheets lenghwise from said lengthwise stack with said common sheet feeding means, and common restacking means for restacking said document sheets in said common tray in the same orientation in which they were loaded therein after they have been copied at said imaging station.

6. The apparatus for signature printing of claim 1 wherein said automatic document reordering and presenting means includes document selector means for selecting predetermined document pages in a predetermined series, alternately from the top and bottom of the set of documents therein, and selectable page rotator means for automatically rotating by 180° selected simplex documents; and recirculative feeder means operatively connected to receive said selected and rotated documents from said document reordering and presenting means, for recirculatively presenting selected successive document page pairs in signature pair orientation and order to said imaging station of said copier and for returning them to said recirculative feeder means for recirculating for precollation copying.

7. The apparatus for signature printing of claim 1 wherein said automatic document recording and presenting means includes integral automatic document feeding means for automatically presenting and representing document sheets in signature pairs to said imaging station of said copier for plural sequential copies thereof, and wherein said appartus for signature printing further includes copy sheet collection and compilation means at the output of the copier coordinated with said automatic document feeder to provide collated signature set books in book page order automatically at said collection and compilation means.

8. The apparatus for signature printing of claim 1 wherein said copier has recirculating document feeding means, and said automatic document reordering and presenting means is an independent modular unit which automatically loads reordered documents into said automatic document reordering and presenting means in document order for plurally recirculating reordered original document sheets therein in signature page order to and from said imaging station of said copier for the automatic production of plural precollated book sets of signature.

9. The apparatus for signature printing of claim 8 wherein said recirculating document feeding means includes means for automatically inverting duplex document sheets for copying both sides thereof, and said automatic document reordering and presenting means includes rotating means for rotating by 180° alternate pairs of documents relative to the other document pairs.

10. The apparatus for signature printing of claim 1 wherein said automatic duplexing copier comprises a single imaging surface and duplexing means for automatically turning over and representing said signature copy sheets to said same imaging surface before outputting said signature copy sheets from said copier for automatically copying said document sheets onto both sides of said signature copy sheets.

11. The apparatus for signature printing of claim 8 wherein said automatic duplexing copier has a single imaging surface and duplexing means for automatically turning over and representing said signature copy sheets to said same imaging surface before outputting said signature copy sheets from said copier for automatically copying said document sheets onto both sides of said signature copy sheets.

12. The apparatus for signature printing of claim 1, further including modular center-folding and saddle-fastener means operatively connecting with the output of said signature copy sheets by said copier to compile and center-stitch therein said collated signature sets.

13. The apparatus for signature printing of claim 8, further including a modular center-folding and saddle-fastener unit operatively connecting with said copier output of said signature copy sheets, wherein said center-folding and saddle-fastener unit center-folds each copy sheet adjacent the output of the copier individually in the direction of movement of the copy sheets and automatically accumulates booklets of collated signature sets of collated output copy sheets from the output of said copier for on-line saddle-fastening finishing, said center-folding saddle-fastener unit having automatic on-line means for roof-shaped compiling said folded copy sheets into booklet sets, and means for center-saddle-fastening together said copy sheets of each such complied booklet set.

14. In the method of signature printing with an automatically duplexing copier by presenting plural document sheets to the imaging station of the copier in a predetermined nonserial page order for producing a set of signature copy sheets comprising copies of said plural document sheets in signature page order, suitable for subsequent center-folding of said set of signature sheets into page order signature sets, the improvement comprising the steps of:

loading a set of document sheets into an automatic document reordering and presenting system associated with said copier in normal serial(nonsignature)page order, automatically reordering said set of document sheets with said automatic document reordering and presenting system into a predetermined nonserial reordered page order for signature page order copying for collated signature set output from said copier, and automatically presenting pairs of said reordered document sheets to said imaging station to be copied in said reordered page order from said automatic document reordering and presenting system so as to provide plural completed page order signature sets automatically with said copier without requiring any manual reordering of either the document sheets or the signature copy sheets.

15. The method of signature printing of claim 14 wherein said automatic reordering step includes automatic rotation of selected simplex document sheets after said loading step and before said step of presenting them to be copied to provide proper orientation of document pages for said automatic duplex copier, and automatic feeding of documents alternately from opposite sides of the set of normal serial (nonsignature) page order document sheets loaded into said automatic document reordering and presenting system.

16. The method of signature printing of claim 15 wherein said document sheets are automatically separated into two stacks in said automatic reordering step by said automatic document reordering and presenting system, and two document sheets at a time are simultaneously presented lengthwise (short-edge-first) in parallel to said imaging station for copying from said two stacks, in the page relationship to one another of adjacent pages of a signature sheet.

17. The method of signature printing of claim 15 wherein two document sheets are presented sequentially to said imaging station sideways (long-edge-first) to be simultaneously copied at said imaging station to form the adjacent pages of a signature copy sheet.

18. The method of signature printing of claim 14 wherein signature sheets are made by copying one pair of document sheets at a time at said imaging station onto one side of a signature sheet to make one signature page side in each copying cycle of said copier and then the next order signature page is made from the next pair of reordered document sheets, said reordered document page pairs being automatically plurally, recirculatively copied to automatically produce plural precollated, pregathered quires in book page order as the copier output without requiring a collator or collation of the copier output.

19. The method of signature printing of claim 18 wherein said automatic reordering step includes automatic rotation of alternate pairs of simplex document sheets after said loading step and before they are first presented to be copied.

20. The method of signature printing of claim 16 wherein signature sheets are made by copying one pair of document sheets at a time at said imaging station onto one side of a signature sheet to make one signature page side in each copying cycle of said copier and then the next order signature page is made from the next pair of reordered document sheets, said reordered document page pairs being plurally recirculatively copied to automatically produce precollated, pregathered, quires in book page order as the copier output without requiring a collator or collation of the copier output.

21. Apparatus for signature printing with an automatic duplexing copier by presenting document sheets to the imaging station of the copier in a signature page order for producing signature copy sheets comprising copies of signature pairs of said document sheets on both sides of said copy sheets so that said copy sheets can be folded into page order signature sets comprising:

automatic document reordering and presenting means associated with said copier and adapted to receive a stacked set of document sheets loaded therein in normal sequential serial (nonsignature) page order, said automatic document reordering and presenting means comprising means for automatically reordering said document sheets from said normal sequential page order into signature page order by feeding out individual said document sheets alternately from the top and bottom of said stacked set of document sheets therein, for automatically presenting said reordered document sheets to said imaging station in signature page order for automatic duplex copying in copying cycles for automatically providing duplexed signature copy sheets in proper page order signatures as the output of said copier.

22. The apparatus for signature printing of claim 21 including means for automatically sequentially presenting said reordered document sheets to said imaging station in proper signature page order for copying two said reordered document sheets onto one side of a single copy sheet to form one side of a signature copy sheet, and copying two further said reordered document sheets onto the opposite side of said copy sheet to form a completed signature copy sheet.

23. The apparatus for signature printing of claim 21 wherein said automatic document reordering and presenting means includes automatic document recirculative feeder means operatively connected to receive said reordered documents and plurally recirculatively represent them in signature pair order for precollation copying and plural precollated page order signature sets.

24. The apparatus for signature printing of claim 22 wherein said automatic document reordering and presenting means includes automatic document recirculative feeder means operatively connected to receive said reordered documents and plurally recirculatively represent them in signature pair order for precollation copying and plural precollated page order signature sets.

25. The apparatus for signature printing of claim 21 wherein said copier has recirculating document feeding means with at least one document sheet loading input, and said automatic document reordering and presenting means comprises an independent modular document reordering unit which automatically loads reordered documents into said recirculating document feeding means and is mounted adjacent to and in document sheet feeding communication with said document sheet loading input of said recirculating document feeding means.

26. The apparatus for signature printing of claim 22 wherein said copier has recirculating document feeding means with at least one document sheet loading input, and said automatic document reordering and presenting means comprises an independent modular document reordering unit which automatically loads reordered documents into said recirculating document feeding means and is mounted adjacent to and in document sheet feeding communication with said document sheet loading input of said recirculating document feeding means.

27. The apparatus for signature printing of claim 24 wherein said automatic document recirculative feeding means includes means for automatically inverting duplex document sheets for copying both sides thereof; and wherein said automatic document reordering and presenting means further includes rotating means for rotating by 180° alternate pairs of document sheets before they are presented for copying by said recirculative feeding means.

28. The apparatus for signature printing of claim 23 wherein said automatic duplexing copier comprises a single imaging surface and automatic duplexing means for automatically turning over and representing said signature copy sheets to said same imaging surface before outputting said signature copy sheets from said copier for automatically copying said document sheets onto both sides of said signature copy sheets.

29. The apparatus for signature printing of claim 22 wherein said reordered document sheets are automatically sequentially fed to said imaging station of said copier for copying oriented long-edge-first.

30. In the method of signature printing with an automatically duplexing copier by presenting document sheets to the imaging station of the copier in a predetermined signature page order for producing signature copy sheets comprising copies of said document sheets in signature page order, suitable for subsequent folding of sets of said signature sheets into proper page signature sets, the improvement comprising the steps of:

stacking the set of document sheets to be copied into an automatic document reordering and presenting system associated with said copier in normal sequential serial(nonsignature) page order, automatically reordering said set of document sheets with said automatic document reordering and presenting system into a predetermined signature page order for signature copying output from said copier by alternatively feeding out individual document sheets from the top and bottom of said stack until the entire stack has been fed out from said stack in this manner, without circulating said stack, and automatically presenting said reordered document sheets to said imaging station to be copied in said reordered page order to automatically provide plural completed page order signature copy sheets with said copier.

31. The method of signature printing of claim 30 wherein said automatic reordering step also includes automatic rotation of selected simplex document sheets after said loading step and before said step of presenting them to be copied for providing proper orientation of document pages for said automatic duplex copier when said automatic duplex copier feeds copy sheets long-edge-first.

32. The method of signature printing of claim 30 wherein said reordered document sheets are presented sequentially to said imaging station sideways(long-edge-first)to be copied at said imaging station to form the adjacent pages of a signature copy sheet.

33. The method of signature printing of claim 30 wherein said signature sheets are made by copying two sequentially reordered and presented document sheets onto one side of a copy sheet to make one side of a signature and then copying another two sequentially reordered and presented document sheets onto another side of a copy sheet.

34. The method of signature printing of claim 30 wherein said reordered document sheets are automatically plurally recirculatively sequentially copied to automatically produce plural precollated, pregathered quires of said signature copy sheets in book page order as the copier output without requiring a collator or collation of the copier output.

* * * * *